US011247456B2

(12) United States Patent
Nijkamp et al.

(10) Patent No.: US 11,247,456 B2
(45) Date of Patent: Feb. 15, 2022

(54) CIRCUIT AND METHOD FOR MEASURING VOLTAGE AMPLITUDE WAVEFORMS IN A PRINTER

(71) Applicant: Océ Holding B.V., Venlo (NL)

(72) Inventors: Aart Nijkamp, Venlo (NL); Johannes M. M. Simons, Venlo (NL); Cornelis W. M. Venner, Venlo (NL)

(73) Assignee: Canon Production Printing Holding B.V., Venlo (NL)

( * ) Notice: Subject to any disclaimer, the term of this patent is extended or adjusted under 35 U.S.C. 154(b) by 47 days.

(21) Appl. No.: 16/678,059

(22) Filed: Nov. 8, 2019

(65) Prior Publication Data

US 2020/0156368 A1 May 21, 2020

(30) Foreign Application Priority Data

Nov. 19, 2018 (EP) ..... 18207038

(51) Int. Cl.
*B41J 2/045* (2006.01)

(52) U.S. Cl.
CPC ..... *B41J 2/04581* (2013.01); *B41J 2/04525* (2013.01); *B41J 2/04588* (2013.01)

(58) Field of Classification Search
CPC ..... B41J 2/04581; B41J 2/04588; B41J 2/04525; B41J 2/04541
See application file for complete search history.

(56) References Cited

U.S. PATENT DOCUMENTS

| | | | |
|---|---|---|---|
| 6,719,390 | B1 | 4/2004 | Howkins et al. |
| 9,698,809 | B1 | 7/2017 | Mallett |

FOREIGN PATENT DOCUMENTS

| | | | |
|---|---|---|---|
| EP | 3144151 | A1 | 3/2017 |
| EP | 3213919 | A1 | 9/2017 |
| JP | 3346454 | B2 | 11/2002 |
| WO | WO 2011/093889 | A1 | 8/2011 |

OTHER PUBLICATIONS

Search Report issued in European priority application 18207038.3, dated May 9, 2019.

*Primary Examiner* — Jannelle M Lebron
(74) *Attorney, Agent, or Firm* — Birch, Stewart, Kolasch & Birch, LLP

(57) ABSTRACT

An electrical circuit for measuring the shape of a voltage waveform in a print head of a printer includes an integrated circuit for generating one or more voltage amplitude waveforms. The electrical circuit includes an inkjet drop forming unit including a plurality of inkjet chambers, wherein each of the plurality of inkjet chambers includes a piezoelectric actuator and an ink nozzle, and a connecting circuit between the integrated circuit and the inkjet drop forming unit suitable for applying one of the one or more voltage amplitude waveforms generated by the integrated circuit to the piezoelectric actuator in one of the plurality of inkjet chambers. In order to measure the shape of the one or more generated voltage amplitude waveforms via capacitive crosstalk, the electrical circuit also includes a conductor in physical proximity to the connecting circuit.

11 Claims, 8 Drawing Sheets

CIRCUIT AND METHOD FOR MEASURING VOLTAGE AMPLITUDE WAVEFORMS IN A PRINTER

BACKGROUND OF THE INVENTION

The invention relates to an electrical circuit for measuring voltage amplitude waveforms in a print head of a printer. The invention also relates to a method for measuring said voltage amplitude waveforms using the electrical circuit.

Usually, the electrical circuits used in print heads comprise an inkjet drop forming unit, as for example, a Micro Electromechanical System (MEMS), which is driven by a current source driver that generates a voltage amplitude waveform. As a consequence of this circuit construction, the generated voltage amplitude waveform depends on the capacitive load of the driver.

In order to measure the generated voltage amplitude waveform, it is known using a test line that can be read externally. However, the test line used represents an additional capacitive load, which as a consequence changes the voltage amplitude waveform to be measured, thereby impeding an accurate determination of the voltage amplitude waveform applied to a print head.

An object of the present invention is to provide an electrical circuit that allows measuring voltage amplitude waveforms minimizing the influence of the measurement on the voltage amplitude waveforms being measured, so that a more accurate determination can be performed.

SUMMARY OF THE INVENTION

In an aspect of the present invention, an electrical circuit for measuring voltage amplitude waveforms according to claim 1 is provided. In another aspect of the present invention, a method for measuring voltage amplitude waveforms using the electrical circuit of the present invention is provided.

The electrical circuit of the present invention comprises an integrated circuit for generating one or more voltage amplitude waveforms. These voltage amplitude waveforms are designed to be applied to a piezoelectric actuator present in an ink chamber in a print head. When the designed voltage amplitude waveforms are applied to said piezoelectric actuator, the deformation of the piezoelectric actuator causes the ink in the ink chamber to be jetted through the ink nozzle.

Further, the electrical circuit of the present invention comprises an inkjet drop forming unit. Said inkjet drop forming unit comprises a plurality of inkjet chambers wherein each ink chamber contains a piezoelectric actuator and an ink nozzle.

Also, the electrical circuit of the present invention comprises a connecting circuit between the integrated circuit and the inkjet drop forming unit suitable for applying each of the one or more voltage amplitude waveforms generated by the integrated circuit to the piezoelectric actuator of one of the plurality of inkjet chambers.

Lastly, the electrical circuit of the present invention comprises a conductor in physical proximity to the connecting circuit for measuring the shape of the generated voltage amplitude waveform via capacitive crosstalk. This conductor allows measuring the shape of the generated voltage amplitude waveform minimizing the influence of the measurement on the voltage amplitude waveform to be measured. As a consequence, it allows the present invention performing more accurate determinations of the shape of voltage amplitude waveforms applied to the piezoelectric actuator in one of a plurality of inkjet chambers. Therefore, the present invention allows monitoring small changes in the voltage amplitude waveforms generated during the lifetime of a print head, which allows compensating for those deviations in order to improve the jetting results throughout the lifetime of a print head.

The conductor in physical proximity is placed such that capacitive crosstalk, as explained below in relation with FIG. 2 occurs. Capacitive crosstalk causes a signal on one line to create a smaller version of the same signal on an adjacent line because of the capacitance between the lines. It is necessary, however, that the conductor in physical proximity to the connecting circuit does not create a closed circuit with any of the other components of the electrical circuit of the present invention. In some embodiments of the present invention, the flexible substrate of the flex circuit isolates electrically the conductor from any other electrical element of the circuit, while still allowing a capacitive crosstalk effect.

In an alternative embodiment, the electrical circuit of the present invention comprises the inkjet drop forming unit comprising a Microelectromechanical System, MEMS.

In an alternative embodiment, the present invention comprises the connecting circuit comprising a flexible circuit comprising a plurality of circuit tracks for applying a voltage amplitude waveform to the piezoelectric actuator in one of the plurality of ink chambers.

In an alternative embodiment, the present invention comprises the conductor in physical proximity to the connecting circuit being a circuit track neighbouring the circuit track for which the shape of the generated voltage amplitude waveform is measured.

In an alternative embodiment, the present invention comprises the conductor in physical proximity to the connecting circuit being a capacitive element located on top of the flexible circuit for measuring the shape of the generated voltage amplitude waveform.

In an alternative embodiment, the present invention comprises the capacitive element being located on top of the flexible circuit such that it overlaps all of the plurality of circuit tracks for applying a voltage amplitude waveform.

In an alternative embodiment, the present invention comprises the capacitive element being placed on top of the flexible circuit such that it overlaps a subset of the plurality of circuit tracks for applying a voltage amplitude waveform.

In an alternative embodiment, the present invention comprises a recovery circuit for recovering the generated voltage amplitude waveform from the measured shape of the one or more generated voltage amplitude waveforms via capacitive crosstalk.

A person skilled in the art would readily understand that a conductor in physical proximity to the connecting circuit allows measuring the shape of one or more generated voltage amplitude waveforms via capacitive crosstalk. From the recovered shape of a voltage amplitude waveform it is straightforward, based on knowledge of the amplitude of the generated voltage amplitude waveform, to correctly recover the voltage amplitude waveform from the shape measured via capacitive crosstalk.

BRIEF DESCRIPTION OF THE DRAWINGS

The present invention will become more fully understood from the detailed description given below, and the accompanying drawings which are given by way of illustration only, and are thus not limitative of the present invention, and wherein.

DETAILED DESCRIPTION OF EMBODIMENTS

Figure 1:
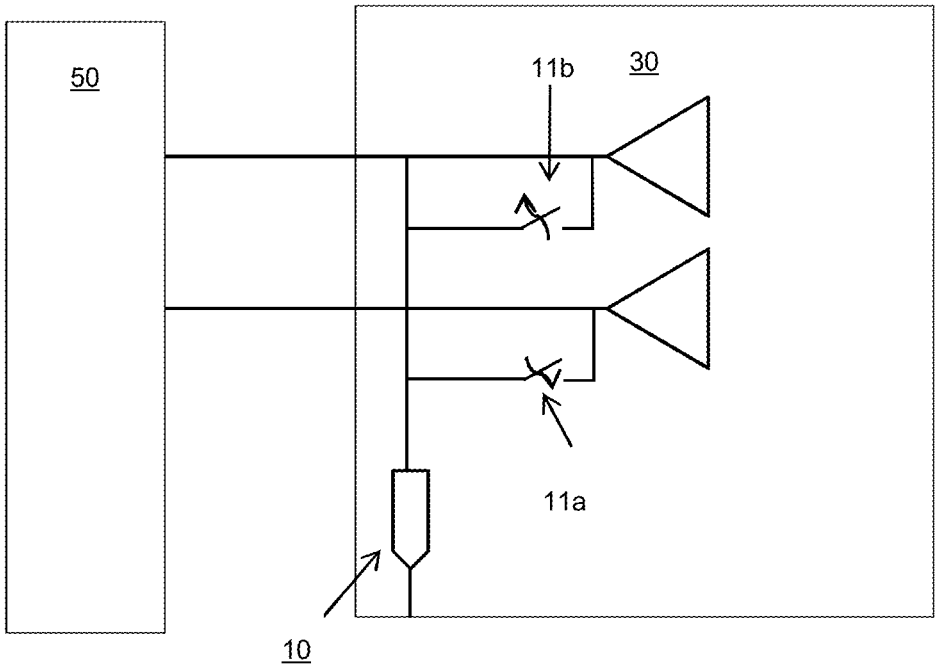
FIG. 1 shows an electrical circuit for measuring voltage amplitude waveforms known in the art.

The present invention will now be described with reference to the accompanying drawings, wherein the same or similar elements are identified with the same reference numeral.

FIG. 1 shows an electrical circuit for measuring voltage amplitude waveforms known in the art. In the circuit of FIG. 1 an integrated circuit 30 for generating one or more voltage amplitude waveforms is shown. The integrated circuit 30 has a plurality of outputs connected to a connecting circuit between the integrated circuit and inkjet drop forming unit 50 suitable for applying one of the one or more voltage amplitude waveforms generated by the integrated circuit to the piezoelectric actuator in one of the plurality of inkjet chambers. In order to be able to measure the shape of voltage amplitude waveforms generated by the integrated circuit, a test line or probe 10 is included in the electrical circuits known in the art. As it can be observed in FIG. 1, the test line 10 is usually connected to an output of the integrated circuit. A plurality of switches 11*a*, 11*b* are also shown. A person skilled in the art would readily understand that each output of the integrated circuit for providing a voltage waveform comprises one switch. In order to perform measurements with test line 10, only one of the plurality of switches is in the closed position. A person skilled in the art would readily understand that a switch is present for each output of the integrated circuit. In order to measure the shape of a voltage amplitude waveform generated by the integrated circuit the switch corresponding to the voltage amplitude waveform to be measured is switched closed, as shown in switch 11*a* in FIG. 1. In this way, the test line 10 is able of measuring the shape of the voltage amplitude waveform. However, the test line used represents capacitive load, which changes the voltage amplitude waveform being measured, thereby impeding an accurate determination of the voltage amplitude waveform applied to the print head.

Figure 2:
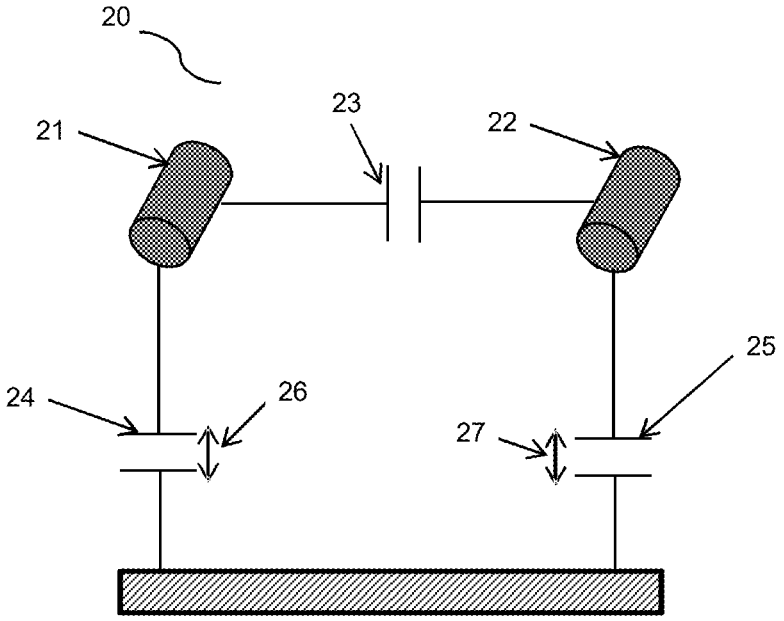
FIG. 2 shows two electrical conductors in physical proximity wherein capacitive crosstalk occurs between them.

FIG. 2 shows an electrical circuit 20 comprising two electrical conductors in physical proximity wherein capacitive crosstalk occurs between them. FIG. 2 shows a first conductor 21 and a second conductor 22 which are in physical proximity. As a consequence of this physical proximity the first conductor 21 and the second conductor 22 are coupled via an electric field. As a consequence, there is a capacitance 23 between the first conductor 21 and the second conductor 22 when, for example, a voltage amplitude waveform travels across the first conductor 21. FIG. 2 also shows capacitance 24 associated with the first conductor 21 and capacitance 25 associated with the second conductor 22. Each of the capacitances 24 and 25 has a respective voltage 26 across the first conductor 21 and a voltage 27 across the second conductor 22. When the voltage in the first conductor 21 changes with time, the capacitance 23 between the first conductor 21 and the second conductor 22 generates a current in the second conductor 22. In this way, a voltage in the first conductor 21 has induced a current (and as a consequence an electrical voltage) in the second conductor 22.

Usually, capacitive crosstalk is an undesired effect, which can be solved using, for example, a screen cable to shield the first conductor 21 from the second conductor 22. In the context of the present invention, capacitive crosstalk can be however used to measure the shape of a voltage amplitude waveform applied to the piezoelectric actuator in an ink chamber, as the current induced in the second conductor 22 is directly related to the mentioned voltage amplitude waveform in the first conductor 21. The relationship is expressed by the following formula:

$$I_{22}=C_{23}*dV_{26}/dt$$

Figure 3:
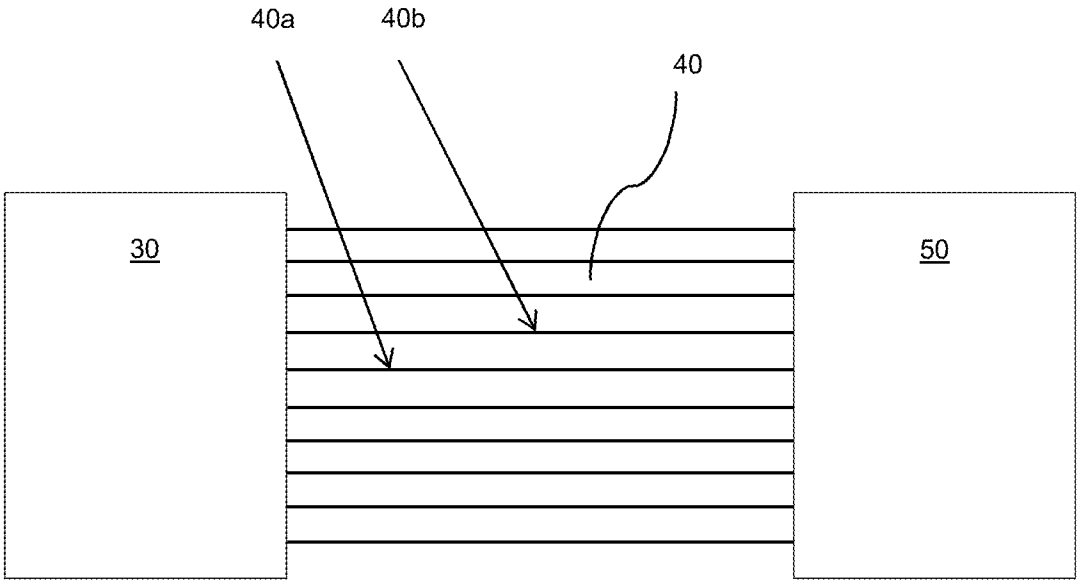
FIG. 3 shows an embodiment of the electrical circuit for measuring voltage amplitude waveforms of the present invention.

FIG. 3 shows an embodiment of the electrical circuit for measuring voltage amplitude waveforms of the present invention. The electrical circuit comprises an integrated circuit 30 for generating one or more voltage amplitude waveforms. The electrical circuit further comprises an inkjet drop forming unit 50 comprising a plurality of inkjet chambers, where each of the plurality of inkjet chambers comprises a piezoelectric actuator and an ink nozzle. FIG. 3 further shows a connecting circuit 40 between the integrated circuit and the inkjet drop forming unit suitable for applying one of the one or more voltage amplitude waveforms generated by the integrated circuit to the piezoelectric actuator in one of the plurality of inkjet chambers. Typically, said connecting circuit 40 comprises a plurality of circuit tracks 40*a*, 40*b* through which a voltage amplitude waveform is applied to the piezoelectric actuator in one of the plurality of inkjet chambers such that ink is jetted through its ink nozzle.

In a particular embodiment, a voltage amplitude waveform is generated in the integrated circuit 30 shown in FIG. 3. Said voltage amplitude waveform is applied to the piezoelectric actuator in one of the inkjet chambers through circuit track 40*a*. As explained above in relation to FIG. 2, a voltage amplitude waveform travelling across circuit track 40*a* induces a current (and as a consequence an electrical voltage) in circuit track 40*b* via capacitive crosstalk. In this embodiment, the current induced by capacitive crosstalk in circuit track 40*b* can be used to infer therefrom the shape of the voltage amplitude waveform travelling across circuit track 40*a*. As mentioned earlier, this is possible because there is a direct relation between the voltage amplitude waveform travelling across circuit track 40*a* and the electrical current induced in circuit track 40*b*. A person of skilled in the art would readily understand that is not mandatory to use a neighboring circuit track but that any circuit tracks in physical proximity, such that a non-negligible current is induced.

Figure 4:
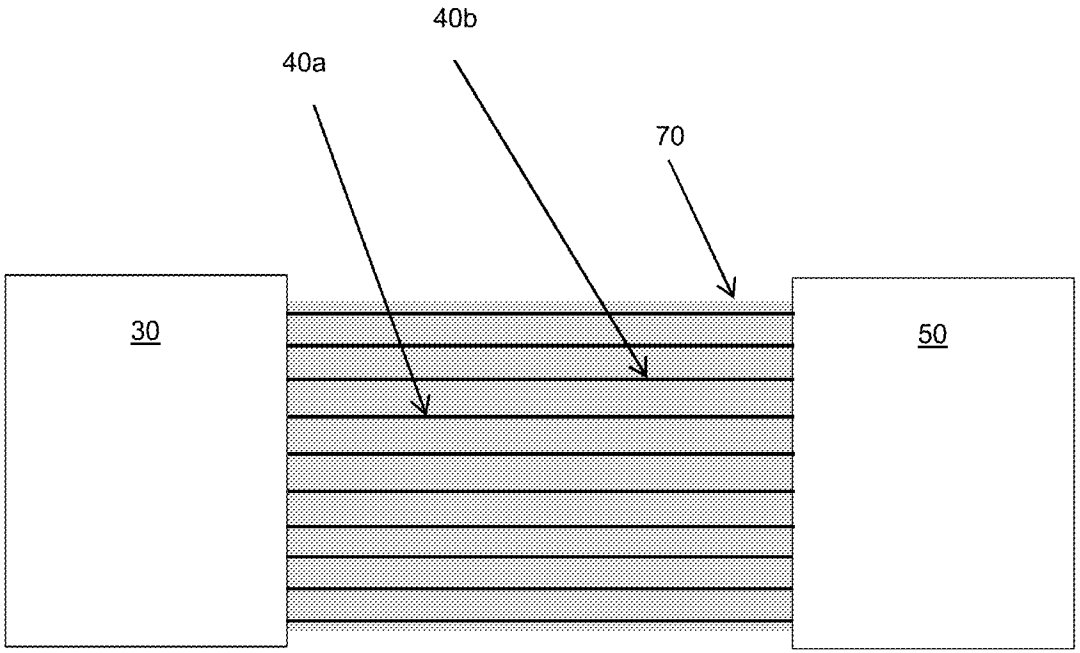
FIG. 4 shows another embodiment of the electrical circuit for measuring voltage amplitude waveforms of the present invention.

FIG. 4 shows another embodiment of the electrical circuit for measuring voltage amplitude waveforms of the present invention. In this embodiment, the connecting circuit comprises a flexible circuit 70 comprising a plurality of circuit tracks for applying a voltage amplitude waveform to the piezoelectric actuator in one of the plurality of inkjet chambers. Flexible circuits, commonly known as flex circuits, are circuits manufactured using a technology for assembling electronic circuits by mounting electronic devices on flexible plastic substrates, such as polyimide, PEEK or transparent conductive polyester film. Additionally, flex circuits can be screen printed silver circuits on polyester. Flexible electronic assemblies may be manufactured using identical components used for rigid printed circuit boards, allowing the board to conform to a desired shape, or to flex during its use. The use of a flexible circuit is particularly advantageous in electrical circuits for inkjet technologies as it allows the electrical circuits to withstand the vibrations typical in these applications.

Figure 5:
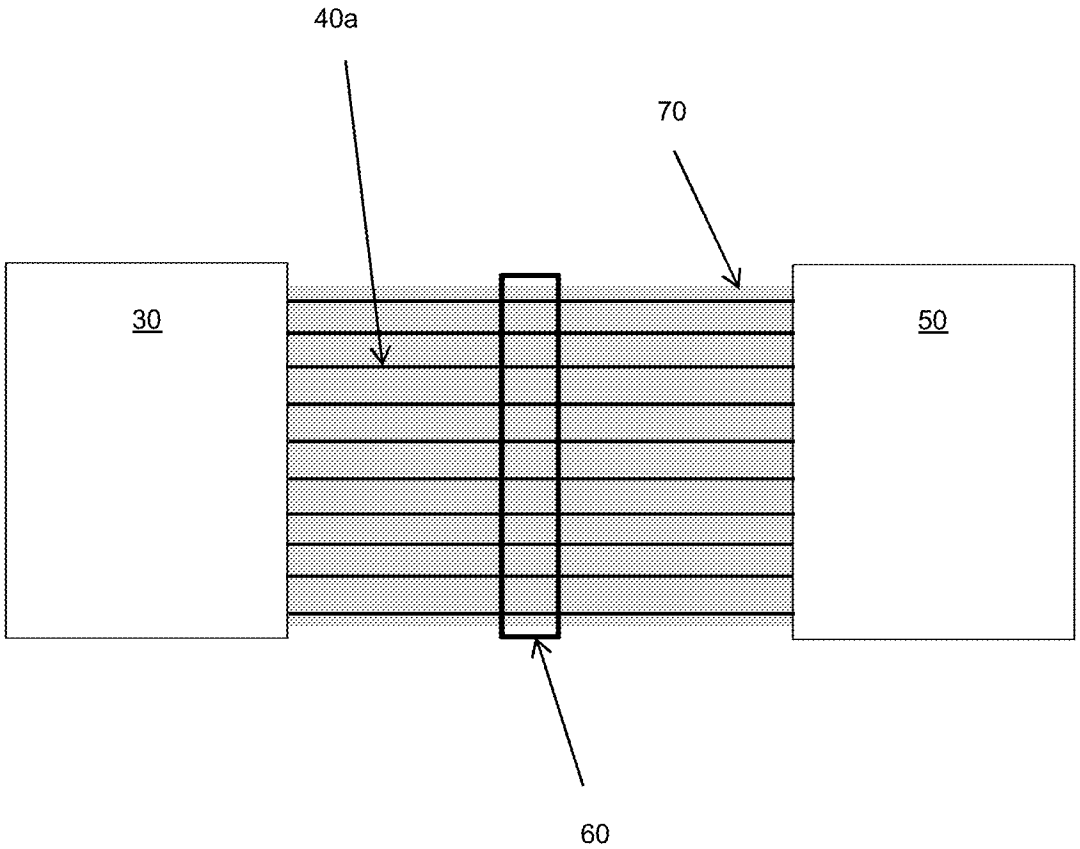
FIG. 5 shows another embodiment of the electrical circuit for measuring voltage amplitude waveforms of the present invention.

FIG. 5 shows another embodiment of the electrical circuit for measuring voltage amplitude waveforms of the present invention. This embodiment also comprises a connecting circuit comprising a flexible circuit 70 comprising a plurality of circuit tracks for applying a voltage amplitude waveform to the piezoelectric actuator in one of the plurality of inkjet chambers. A conductor 60 in physical proximity to the connecting circuit for measuring the shape of one or more generated voltage amplitude waveforms via capacitive crosstalk is also shown in FIG. 5. This conductor 60 is placed in physical proximity to the connecting circuit on top of the flexible circuit 70. Said conductor 60 may be for example a capacitive plate. A person of skill in the art would readily understand that other conductor elements beside a capacitive plate may be used in the context of the present invention such as a capacitive tube or any other conductor element known in the art that allows quantifying the received capacitive crosstalk. As explained above, measuring the shape of one or more generated voltage amplitude waveforms via capacitive crosstalk can be performed according to the principles laid out with reference to FIG. 2 above. As an example, a voltage amplitude waveform is generated in the integrated circuit 30 and is applied to the inkjet drop forming unit 50 through circuit track 20*a*. The voltage amplitude waveform travelling across circuit track 40*a* generates via capacitive crosstalk a voltage amplitude waveform in conductor 60. From said induced capacitive crosstalk, the present invention allows measuring the shape of voltage amplitude waveform travelling across circuit track 20*a* at any point in time. This embodiment allows measuring the shape of voltage amplitude waveform applied to the inkjet drop forming unit while minimizing the influence of the measurement on the shape of the measured voltage amplitude waveform. However, the capacitive crosstalk received by conductor 60 contains two different components, where the first component is the capacitive crosstalk received from the voltage amplitude waveform travelling across circuit track 40*a*, and the second component is noise, wherein the noise component comprises ambient noise (with a main component typically in the 50 Hertz), any electrical noise from other circuit components, as well as common noise in the flex circuit 70 (all outputs present the same noise).

Figure 6:
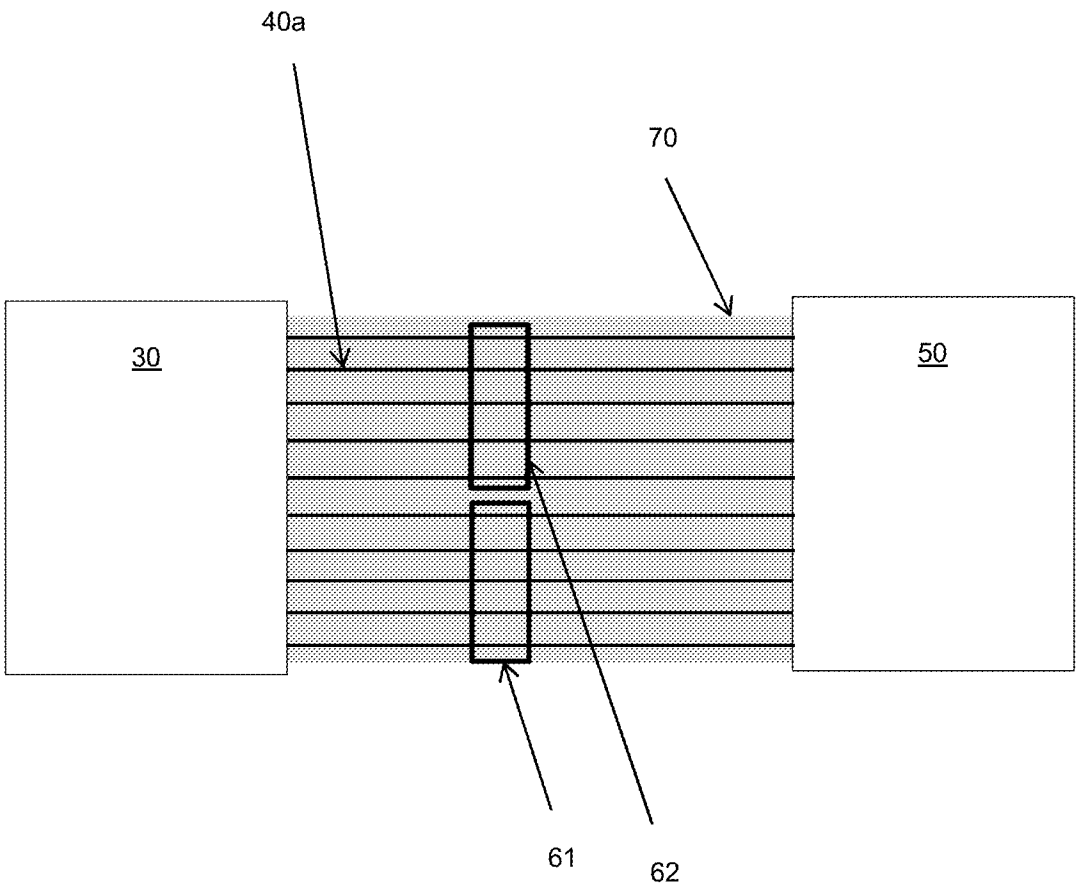
FIG. 6 shows another embodiment of the electrical circuit for measuring voltage amplitude waveforms of the present invention.

FIG. 6 shows another embodiment of the electrical circuit for measuring voltage amplitude waveforms of the present invention. In this embodiment, two conductors 61 and 62 are shown in physical proximity to the connecting circuit for measuring the shape of one or more generated voltage amplitude waveforms via capacitive crosstalk. As it can be observed in FIG. 6, each capacitive plate is placed on top of the flexible circuit such that it overlaps a subset of the plurality of circuit tracks for applying a voltage amplitude waveform. In this particular example each of the conductors 61 and 62 overlap half of the circuit tracks of the connecting circuit. As explained above, measuring the shape of one or more generated voltage amplitude waveforms via capacitive crosstalk can be performed according to the principles laid out with reference to FIG. 2 above. As an example, a voltage amplitude waveform is generated in the integrated circuit 30 and is applied to the inkjet drop forming unit 50 through circuit track 40*a*. The voltage amplitude waveform going across circuit track 40*a* generates via capacitive crosstalk a voltage amplitude waveform in conductor 62. Further, conductor 62 also receives a noise component. As explained above, this noise component comprises ambient noise (with a main component typically in the 50 Hertz), any electrical noise from other circuit components, as well as common noise in the flex circuit 70 (all outputs present the same noise). On the other hand, conductor 61 only receives the noise component. In this way, it is possible to subtract the noise component received by conductor 61 from the capacitive crosstalk received by conductor 62, thereby eliminating the noise component from the measurement of shape of the generated voltage amplitude waveform. Therefore, having a plurality of conductors in closer physical proximity to the generated voltage amplitude waveforms allows improving the accuracy of the measurements performed via capacitive crosstalk, by means of reducing the noise component present in the shape of the measured voltage amplitude waveform.

In the embodiment shown in FIG. 6 each of the conductors 61 and 62 overlap half of the circuit tracks of the connecting circuit, as discussed above. As a consequence thereof, both conductors have the same coupling to the flex circuit, as they have the same overlapping surface, which in turn implies that they have also the same capacitance. A person of skill in the art would readily understand that is not mandatory that both conductors have the same overlapping surface with the flex circuit. If one of the conductors has, merely as an example, an overlapping surface double than the overlapping surface of the other conductor, this difference can be taken into account when subtracting the noise, thereby reaching identical result than with conductors that have the same overlapping surface with the flex circuit.

Figure 7:
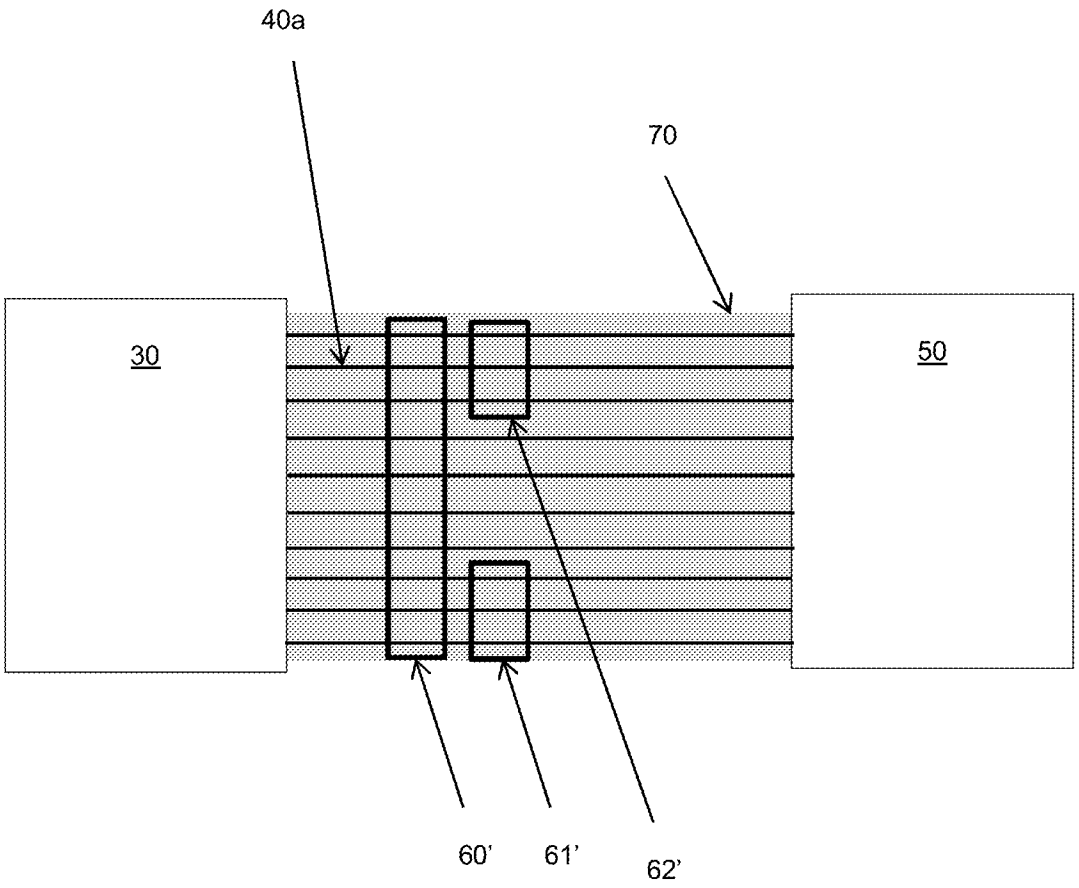
FIG. 7 shows another embodiment of the electrical circuit for measuring voltage amplitude waveforms of the present invention.

FIG. 7 shows another embodiment of the electrical circuit for measuring voltage amplitude waveforms of the present invention. In this embodiment, two conductors 61' and 62' are shown in physical proximity to the connecting circuit for measuring the shape of the one or more generated voltage amplitude waveforms via capacitive crosstalk. It can be observed in FIG. 7 that each of the two conductors overlaps a subset of the plurality of circuit tracks for applying a voltage amplitude waveform, while there is another subset of the plurality of circuit tracks for providing a voltage amplitude waveform for which there is no overlapping conductor. Further, a conductor 60 can be observed in FIG. 7 which overlaps all the circuit tracks in the flex circuit. In this embodiment, conductor 60 receives both a noise component as well as the capacitive crosstalk generated by the voltage amplitude waveform to be measured. At the same time each of the conductors 61' and 62' receives a different part of the noise component. Usually, one of the two conductors 61' or 62' is selected, which is preferably the one which is not affected by the voltage waveform. As a mere example, the conductor at a longer physical distance may be selected. It becomes therefore possible to calculate more accurately than in other embodiments the shape of the voltage amplitude waveform in the circuit tracks which none of the conductors 61' and 62' is overlapping, as it is possible to subtract the noise.

Figure 8A:
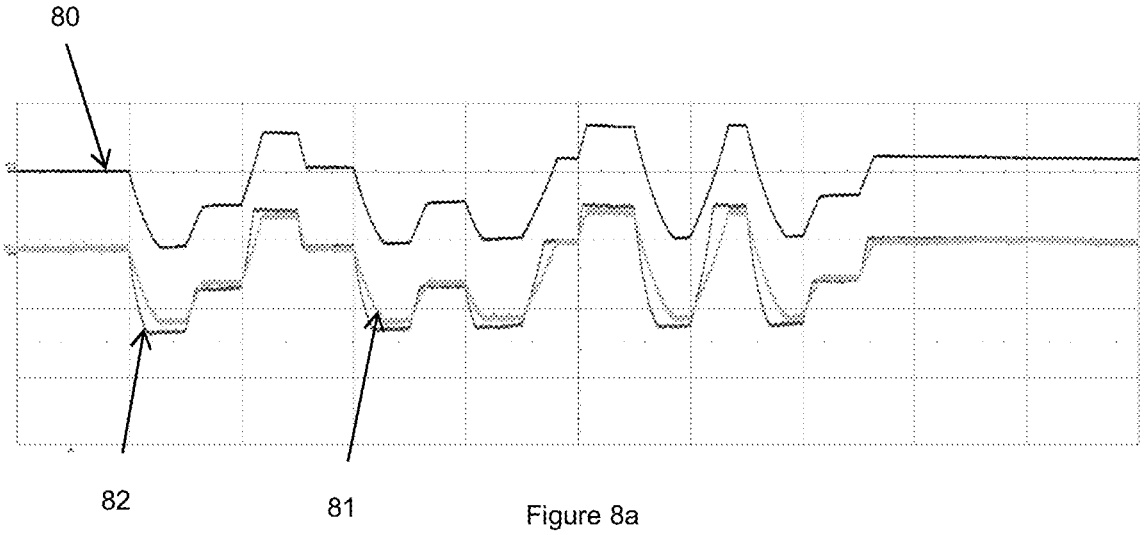
FIG. 8*a* shows a graph portraying different measurements of voltage amplitude waveforms.
Figure 8B:
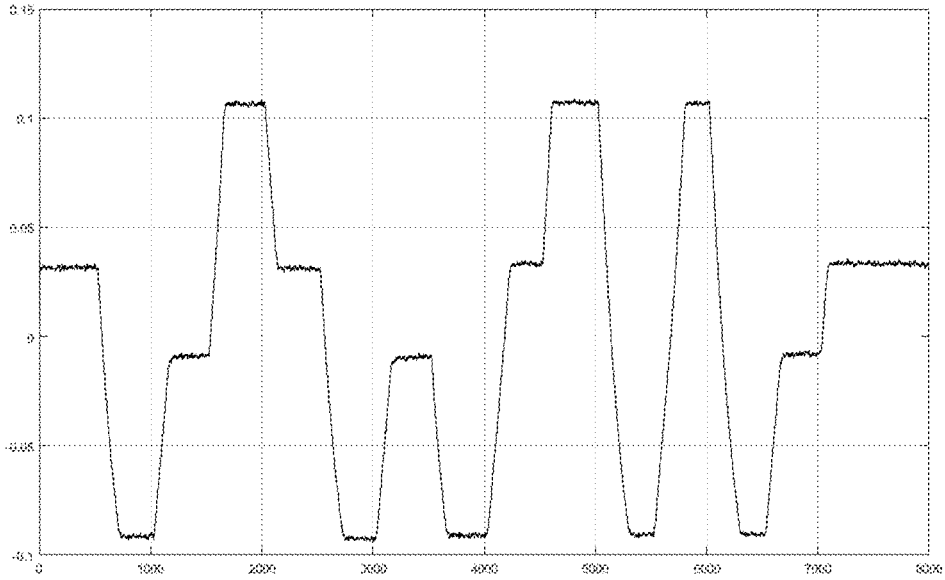
FIG. 8*b* shows a graph portraying a voltage amplitude waveform used in the present invention.

FIG. 8*a* shows a graph portraying different measurements of voltage amplitude waveforms, while FIG. 8*b* shows the measurement of a voltage amplitude waveform performed using the present invention. In the top of FIG. 8*a*, the measurement 80 of a voltage amplitude waveform using a test line, as in the methods known in the art, is shown. As explained above, the measurement with a test line introduces additional impedance, thereby impeding an accurate measurement of the voltage amplitude waveform. FIG. 8*a* also shows measurement 81, which has been performed with the test line 10 of the integrated circuit connected. This measurement is commonly performed in order to ensure that a measurement performed using capacitive crosstalk coincides with the above mentioned measurement using a test line. In case that it is concluded that measurement 81 substantially coincides with measurement 80, the test line is disconnected in order to perform measurement 82, as explained next. FIG. 8*a* also shows measurement 82 of the shape of a voltage amplitude waveform, which has been measured using the present invention. It can be readily observed, when comparing measurement 82 and measurement 80 that measurement 82 contains steeper slopes, due to the influence of the additional capacitance of the test line in measurement 80. Therefore, measurement 82 more accurately represents the shape of the voltage amplitude waveform applied to the piezoelectric actuator in an ink chamber.

A person skilled in the art would readily understand that a conductor in physical proximity to the connecting circuit allows measuring the shape of one or more generated voltage amplitude waveforms via capacitive crosstalk. From the recovered shape of a voltage amplitude waveform it is straightforward, based on knowledge of the amplitude of the generated voltage amplitude waveform to correctly recover the voltage amplitude waveform from the shape measured via capacitive crosstalk. The electrical circuit of the present invention further comprises a recovery circuit for recovering the generated voltage amplitude waveform from the measured shape of the one or more generated voltage amplitude waveforms via capacitive crosstalk. Accordingly the method of the present invention comprises an additional step of recovering the generated voltage amplitude waveform from the measured shape of the one or more generated voltage amplitude waveforms via capacitive crosstalk.

The invention being thus described, it will be obvious that the same may be varied in many ways. Such variations are not to be regarded as a departure from the scope of the invention, and all such modifications as would be obvious to one skilled in the art are intended to be included within the scope of the following claims.

The invention claimed is:

1. An electrical circuit for measuring a voltage amplitude waveform in a print head of a printer, comprising:

an integrated circuit for generating one or more voltage amplitude waveforms;

an inkjet drop forming unit comprising a plurality of inkjet chambers, wherein each of the plurality of inkjet chambers comprises a piezoelectric actuator and an ink nozzle;

a connecting circuit between the integrated circuit and the inkjet drop forming unit suitable for applying one of the one or more voltage amplitude waveforms generated by the integrated circuit to the piezoelectric actuator in one of the plurality of inkjet chambers; and a conductor in physical proximity to the connecting circuit for measuring the shape of one or more generated voltage amplitude waveforms via capacitive crosstalk, wherein the connecting circuit comprises a flexible circuit comprising a plurality of circuit tracks for applying a voltage amplitude waveform to the piezoelectric actuator in one of the plurality of inkjet chambers, and wherein the conductor in physical proximity to the connecting circuit is a capacitive element located on top of the flexible circuit for measuring the shape of the generated voltage amplitude waveform.

2. The electrical circuit of claim 1, wherein the inkjet drop forming unit comprises a Microelectromechanical system, MEMS.

3. The electrical circuit of claim 1, wherein the capacitive element is located on top of the flexible circuit such that it overlaps all of the plurality of circuit tracks for applying a voltage amplitude waveform.

4. The electrical circuit of claim 1, wherein the capacitive element is placed on top of the flexible circuit such that it overlaps a subset of the plurality of circuit tracks for applying a voltage amplitude waveform.

5. The electrical circuit claim 1, further comprising a recovery circuit for recovering the generated voltage amplitude waveform from the measured shape of the one or more generated voltage amplitude waveforms via capacitive crosstalk.

6. A method for measuring a voltage amplitude waveform in an electrical circuit, the electrical circuit comprising:

an integrated circuit for generating one or more voltage amplitude waveforms;

an inkjet drop forming unit comprising a plurality of inkjet chambers, wherein each of the plurality of inkjet chambers comprises a piezoelectric actuator and an ink nozzle;

a connecting circuit between the integrated circuit and the inkjet drop forming unit suitable for applying one of the one or more voltage amplitude waveforms generated by the integrated circuit to the piezoelectric actuator in one of the plurality of inkjet chambers; and a conductor in physical proximity to the connecting circuit for measuring the shape of one or more generated voltage amplitude waveforms via capacitive crosstalk the method comprising:

generating one or more voltage amplitude waveforms with the integrated circuit; and measuring the shape of one or more voltage amplitude waveforms via capacitive crosstalk received by the conductor in physical proximity to the connecting circuit, wherein the connecting circuit comprises a flexible circuit comprising a plurality of circuit tracks for applying a voltage amplitude waveform to the piezoelectric actuator in one of the plurality of inkjet chambers, and wherein the conductor in physical proximity to the connecting circuit is a circuit track neighbouring the circuit track for which the shape of the generated voltage amplitude waveform is measured.

7. A method for measuring a voltage amplitude waveform in an electrical circuit, the electrical circuit comprising:

an integrated circuit for generating one or more voltage amplitude waveforms;

an inkjet drop forming unit comprising a plurality of inkjet chambers, wherein each of the plurality of inkjet chambers comprises a piezoelectric actuator and an ink nozzle;

a connecting circuit between the integrated circuit and the inkjet drop forming unit suitable for applying one of the one or more voltage amplitude waveforms generated by the integrated circuit to the piezoelectric actuator in one of the plurality of inkjet chambers; and a conductor in physical proximity to the connecting circuit for measuring the shape of one or more generated voltage amplitude waveforms via capacitive crosstalk the method comprising:

generating one or more voltage amplitude waveforms with the integrated circuit; and measuring the shape of one or more voltage amplitude waveforms via capacitive crosstalk received by the conductor in physical proximity to the connecting circuit, wherein the connecting circuit comprises a flexible circuit comprising a plurality of circuit tracks for applying a voltage amplitude waveform to the piezoelectric actuator in one of the plurality of inkjet chambers, and wherein the conductor in physical proximity to the connecting circuit is a capacitive element for measuring the shape of the generated voltage amplitude waveform on top of the flexible circuit.

8. The method of claim 7, further comprising recovering the generated voltage amplitude waveform from the measured shape of the one or more generated voltage amplitude waveforms via capacitive crosstalk.

9. The method of claim 7, wherein the capacitive element is placed on top of the flexible circuit such that it overlaps all of the plurality of circuit tracks for applying a voltage amplitude waveform.

10. The method of claim 7, wherein the capacitive element is placed on top of the flexible circuit such that it overlaps a subset of the plurality of circuit tracks for applying a voltage amplitude waveform.

11. The method of claim 6, further comprising recovering the generated voltage amplitude waveform from the measured shape of the one or more generated voltage amplitude waveforms via capacitive crosstalk.

* * * * *